US007382336B2

(12) United States Patent
Lee

(10) Patent No.: US 7,382,336 B2
(45) Date of Patent: Jun. 3, 2008

(54) METHOD AND APPARATUS FOR DRIVING PLASMA DISPLAY PANEL

(75) Inventor: Jun Hak Lee, Suwon-si (KR)

(73) Assignee: LG Electronics Inc., Seoul (KR)

( * ) Notice: Subject to any disclaimer, the term of this patent is extended or adjusted under 35 U.S.C. 154(b) by 618 days.

(21) Appl. No.: 10/794,072

(22) Filed: Mar. 4, 2004

(65) Prior Publication Data

US 2005/0007309 A1 Jan. 13, 2005

(30) Foreign Application Priority Data

Mar. 4, 2003 (KR) ..... 10-2003-0013370

(51) Int. Cl.
*G09G 3/28* (2006.01)

(52) U.S. Cl. ..... 345/60; 345/63

(58) Field of Classification Search ..... 345/60–67, 345/55, 90, 37; 315/169.4, 169.1; 313/582, 313/584, 586, 574, 633
See application file for complete search history.

(56) References Cited

U.S. PATENT DOCUMENTS

| | | | | |
|---|---|---|---|---|
| 6,104,361 | A * | 8/2000 | Rutherford | 345/55 |
| 6,697,085 | B2 * | 2/2004 | Lai et al. | 345/690 |
| 7,119,766 | B2 * | 10/2006 | Otobe et al. | 345/63 |
| 2002/0130826 | A1 * | 9/2002 | Otobe et al. | 345/60 |
| 2003/0076335 | A1 * | 4/2003 | Lai et al. | 345/589 |
| 2003/0142056 | A1 * | 7/2003 | Okamoto | 345/90 |

* cited by examiner

*Primary Examiner*—Nitin I. Patel
(74) *Attorney, Agent, or Firm*—Lee, Hong, Degerman, Kang & Schmadeka

(57) ABSTRACT

The present invention relates to a method and apparatus for driving a plasma display panel. The method for driving a plasma display panel, the method including the steps of: tracing an average locus by using luminous centers existing at each gray scale; extracting gray scales corresponding to the luminous centers existing within a predetermined range of the average locus; and deducing non-extracted gray scales by using the extracted gray scales.

16 Claims, 8 Drawing Sheets

METHOD AND APPARATUS FOR DRIVING PLASMA DISPLAY PANEL

CROSS REFERENCE TO RELATED APPLICATIONS

Pursuant to 35 U.S.C. § 119, this application claims the benefit of earlier filing date and right of priority to Korean Application No. 10-2003-0013370, filed on Mar. 4, 2003, the contents of which are hereby incorporated by reference herein in their entirety.

BACKGROUND OF THE INVENTION

1. Field of the Invention

The present invention relates to a plasma display panel, and more particularly, to a method and apparatus for driving a plasma display panel in which false contour can be reduced.

2. Description of the Related Art

As the information processing system advances and its supply is expanded, a display device is of increasing importance as visual information transmitting means. A cathode ray tube forming a main stream of such display devices has disadvantages of a large volume, a high operation voltage and a screen distortion. Recently, a Liquid Crystal Display (LCD), a Field Emission Display (FED) and a Plasma Display Panel (PDP) are under development for solving the aforementioned disadvantages of the cathode ray tube.

Among such flat display devices, the PDP is a device to display a picture through excitation and radiation of a phosphor by a vacuum ultraviolet generated at the time of discharging an inert mixture gas. The PDP has advantages in that it can be slimmed and large-sized, its manufacture is easy due to a simple structure, and luminance and radiation efficiency are higher than those in other flat display devices. Especially, an alternate current surface discharge PDP has advantages of a low voltage operation and a long life since a wall charge is accumulated on a surface at the time of a discharge and the accumulated chargers protects the electrodes from sputtering generated by the discharge.

FIG. 1 illustrates a conventional three-electrode alternate current surface discharge type plasma display panel.

Referring to FIG. 1, the alternate current surface discharge type PDP includes a front glass substrate 1 having a front electrode 9 formed thereon, and a rear glass substrate 2 having an address electrode 4 formed thereon. The front glass substrate 1 and the rear glass substrate 2 have a barrier rib 3 interposed therebetween and are distant away from each other in parallel. A mixture gas such as Ne+Xe, He+Xe, He+Ne+Xe is injected into a discharge space provided by the front glass substrate 1, the rear glass substrate 2 and the barrier rib 3.

Two front electrodes 9 are paired within one plasma discharge cell. Each of the front electrodes 9 includes a transparent electrode having a wide width, and a bus electrode having a narrow width connected to an edge of one side of the transparent electrode. Any one of the paired front electrodes 9 is used as a scan electrode for allowing a facing discharge to be generated together with an address electrode in response to a scan pulse supplied at an addressing period, and then allowing a surface discharge to occur with an adjacent front electrode in response to a sustain pulse supplied at a sustain period, and the other one is used as a sustain electrode paired with the scan electrode to commonly supply the same sustain pulse therethrough.

A front dielectric layer 7 and a protective layer 8 are layered on the front glass substrate 1 having the front electrode 9 formed thereon. When a plasma discharge is performed, the front dielectric layer 7 limits a discharge current and concurrently, charges the wall charge therein. The protective layer 8 is formed of magnesium oxide (MgO). The protective layer 8 prevents the front dielectric layer 7 from being damaged by the sputtering generated at the time of the plasma discharge, and increases an emission efficiency of a secondary electron.

A rear dielectric layer 6 is formed on the rear glass substrate 2 to cover the address electrode 4. The rear dielectric layer 6 protects the address electrode 4. The barrier rib 3 for partitioning the discharge space is formed on the rear dielectric layer 6. On surfaces of the rear dielectric layer 6 and the barrier rib 3 is coated a phosphor 5 excited by the vacuum ultraviolet for generating visible rays of Red (R), Green (G) and Blue (B).

Generally, in order to express a gray scale of a picture, the PDP is time-division driven in a so-called Address and Display Separated (ADS) way of performing a separation into an address period during which a pixel is selected, and a sustain period during which a display discharge is generated from the selected pixel. That is, one frame period is divided into several sub-fields having the number of the sustain pulses (that is, sustain discharge times) that are differently set according to a luminance weighting value. Each of the sub-fields is divided into a reset period, the address period and the sustain period. For example, in case that it is intended to express a gray scale of 256, a frame period (16.67 ms) corresponding to 1/60 second is divided into eight sub-fields (SF1 to SF8) as shown in FIG. 2. Additionally, each of the eight sub-fields is divided into the reset period, the address period and the sustain period as described beforehand. At this time, the reset period and the address period are identical with each other every sub-field, whileas the sustain period and the number of the sustain pulses allocated at the sustain period are increased in a ratio of $2^n$ (n=0,1,2,3,4,5,6,7) at each of the sub-fields.

Accordingly, the number of the sustain pulses allocated to each of the sub-fields is combined to express a certain gray scale. For example, in order to express a gray scale of 64, the discharge should be made as many as the number of the sustain pulses that are generated by switching on the sub-fields SF1, SF2, SF3, SF4, SF5, SF6 to respectively accumulate the luminance weighting values of $2^0$, $2^1$, $2^2$, $2^3$, $2^4$, $2^5$.

However, if a moving picture is expressed in the above ADS driving way, contours unpleasant to the eye appear around a moving object thereby deteriorating a screen quality. This is called a false contour. The false contour is caused by a difference between luminous centers on a time axis. Herein, the luminous centers represent temporal light centers of the sub-fields that are switched-on (that is, selected during the address period) within one frame. For example, as shown in FIG. 2, the sub-fields SF1, SF2, SF3, SF4, SF5 are switched on to accumulate the luminance weighting values of $2^0$, $2^1$, $2^2$, $2^3$, $2^4$ so as to express a gray scale of 31, whileas only the sub-field SF6 is switched on to embody the gray scale of 31 only using the luminance weighting value $2^5$ so as to express a gray scale of 32. At this time, the discharge should be made during a long period of as much as the sub-fields SF1, SF2, SF3, SF4, SF5 so as to express the gray scale of 31, but the discharge should be made during a short period of as much as the sub-field SF5 so as to express the gray scale of 32. That is, the gray scale of 31 and the gray scale of 32 have a difference of one gray scale therebetween, but the luminous centers of the gray scale of 31 and the gray scale of 32 are considerably different from each other. That is, as shown in FIG. 2, the luminous center at the time of expressing the gray scale of 31 is positioned after a middle portion of one frame, whileas the luminous center at the time of expressing the gray scale of 32 is positioned at an initial portion of one frame such that each of the luminous centers of the gray scale of 31 and the gray scale of 32 is positioned with a considerable difference in time.

After all, the false contour occurs when the luminous center between adjacent gray scales is rapidly changed on the time axis of the frame when the moving picture is embodied.

For example, as shown in FIG. 3, if a gray scale of 127 and a gray scale of 128 move to the right, when an observer traces an object moving along a locus of (A), he/she perceives a brightness with the gray scale of 127, and when tracing an object moving along a locus of (C), he/she perceives a brightness with the gray scale of 128.

However, if the observer traces the object moving along a locus (B) positioned at a boundary of the locus (A) and the locus (C), he/she perceives a very shining brightness with the gray scale of 255 obtained by accumulating the gray scale of 127 and the gray scale of 128.

This applicant suggests a method for not only enabling a high speed drive, but also improving a contrast and the false contour of the moving picture by using a selective write sub-field at which an on-cell is selected and a selective erase sub-field at which an off-cell is selected during one frame period through a Selective Write Selective Erase sub-field (SWSE) driving way, in earlier filed Korean Patent Application Nos.: 1020000012669, 1020000053214, 1020010003003 and 1020010006492.

However, even the above earlier filed applications have a disadvantage in that the false contour appears since the luminous centers can be differentiated on the time axis when the adjacent gray scales are expressed.

SUMMARY OF THE INVENTION

Accordingly, the present invention is directed to a method and apparatus for driving a plasma display panel that substantially obviate one or more problems due to limitations and disadvantages of the related art.

An object of the present invention is to provide a method and apparatus for driving a plasma display panel in which gray scales capable of generating false contour are deduced from gray scales not generating false contour, which are extracted from luminous centers at each gray scale, by using error diffusion and the like so that the false contours can be reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a method for driving a plasma display panel, the method including the steps of: tracing an average locus by using luminous centers existing at each gray scale; extracting gray scales corresponding to the luminous centers existing within a predetermined range of the average locus; and deducing non-extracted gray scales by using the extracted gray scales.

In another aspect of the present invention, there is provided a method for driving a plasma display panel, the method including the steps of: setting gray scales generating false contour or gray scales not generating false contour to process an input gray scale; and processing the input gray scale by using the set gray scales.

The input gray scale processing step includes: referring to the set gray scales to check whether or not the input gray scale is the gray scale generating false contour; and performing error diffusion for the input gray scale by using the set gray scales in case that the input gray scale is the gray scale generating false contour.

In a further aspect of the present invention, there is provided an apparatus for driving a plasma display panel, the apparatus including: a unit for setting gray scales generating false contour or gray scale not generating false contour to process an input gray scale; and a unit for processing the input gray scale by using the set gray scales.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

A driving method of a plasma display panel (PDP) according to the present invention uses gray scales no generatin false contour to deduce gray scales generating false contour.

For this, first of all, a method for obtaining the gray scale not generating false contour.

Figure 1:
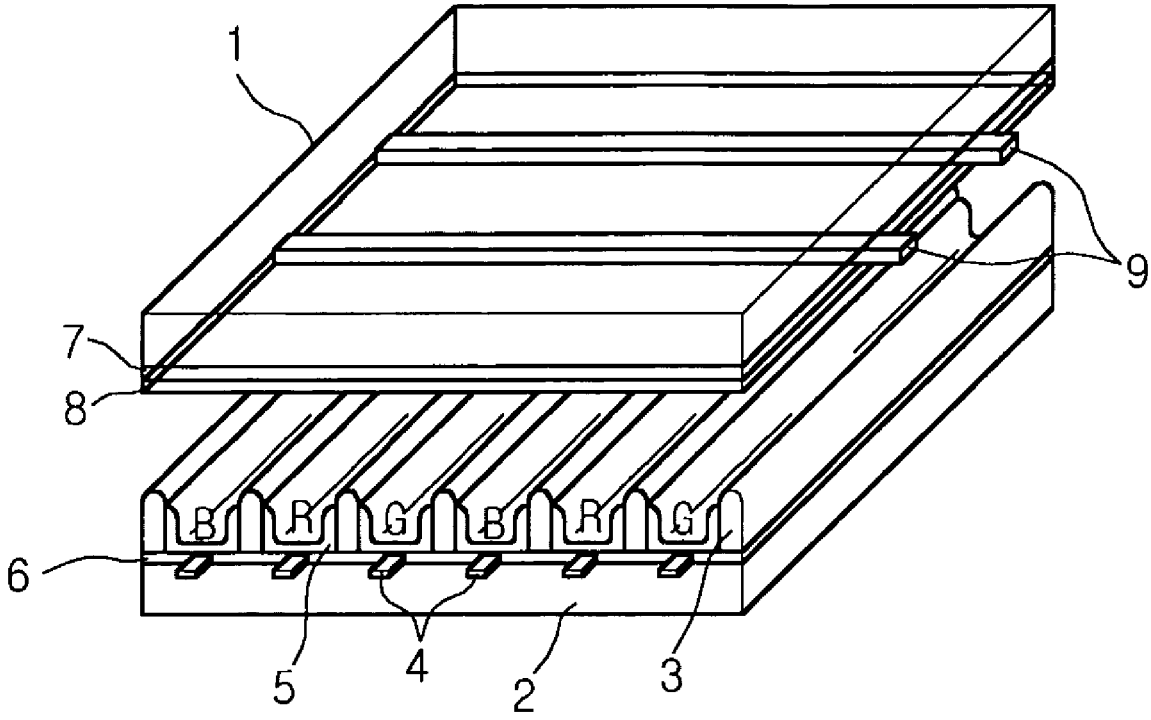
Fig.1 Related Art
FIG. 1 illustrates a conventional three-electrode alternate current surface discharge type plasma display panel.
Figure 2:
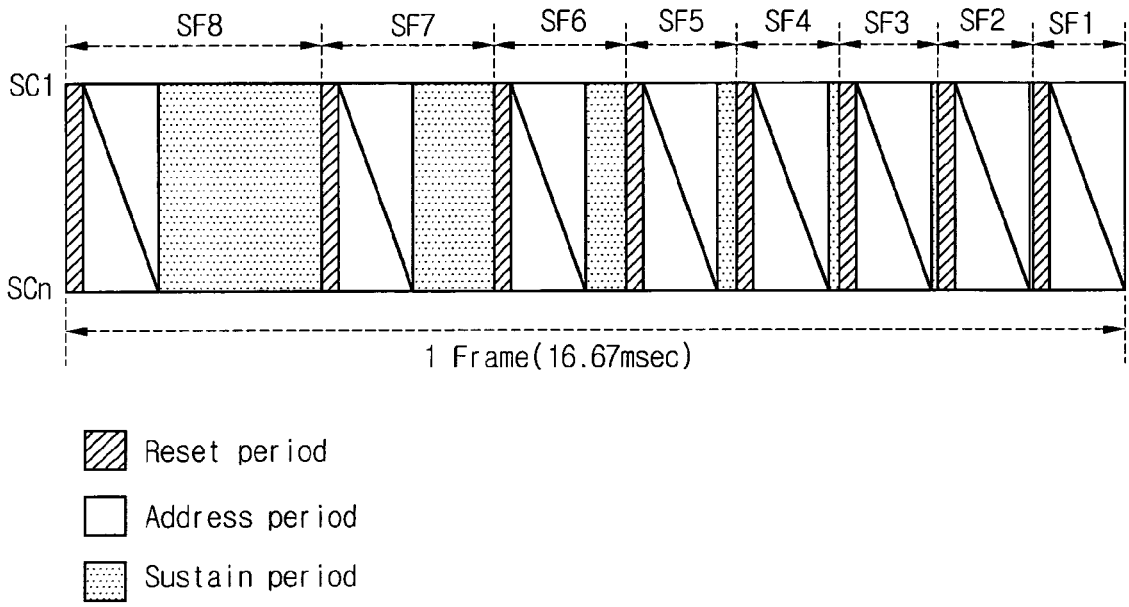
Fig.2 Related Art
FIG. 2 illustrates a sub-field pattern in which one frame period is divided into eight sub-fields.
Figure 3:
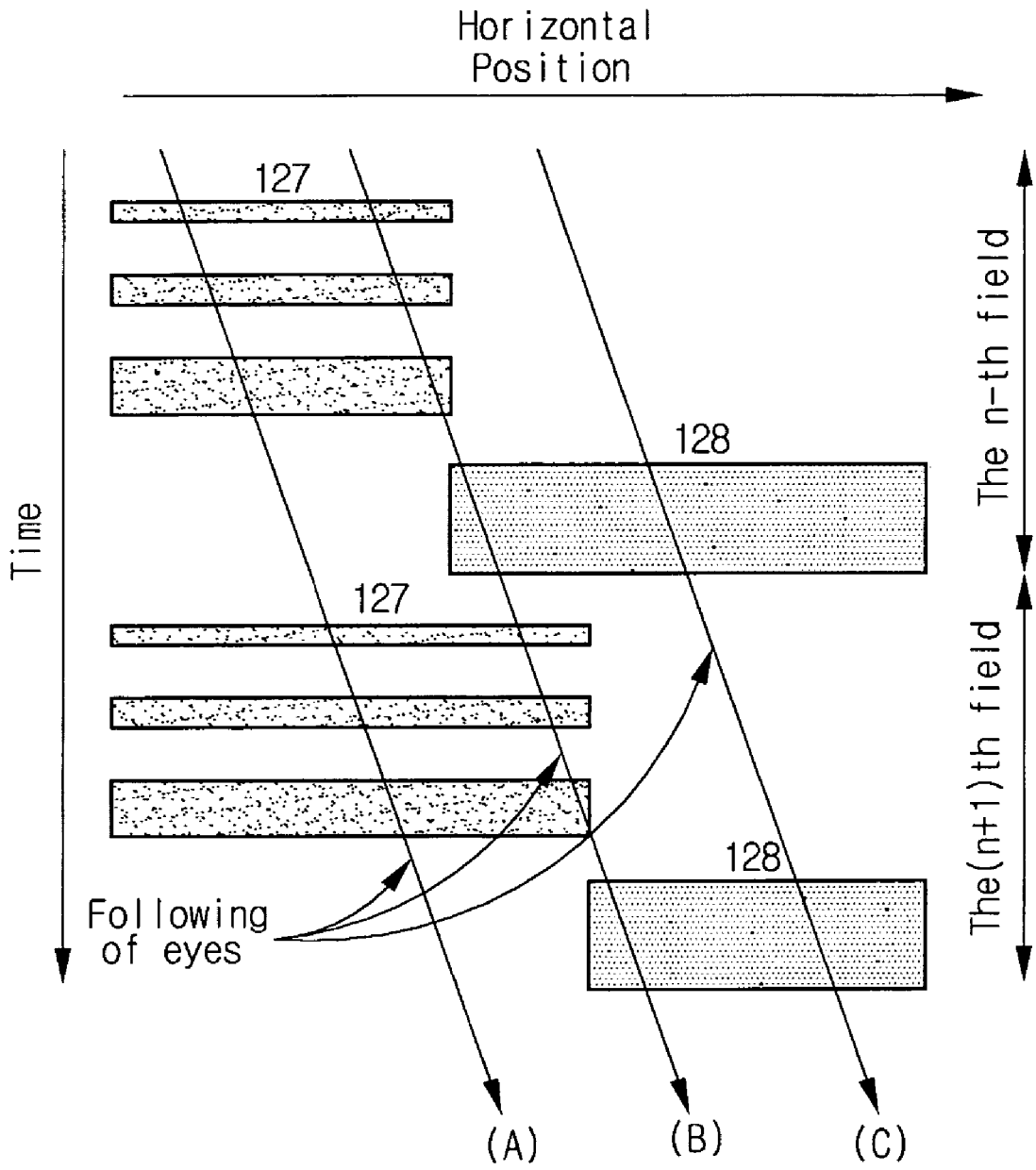
Fig.3 Related Art
FIG. 3 illustrates one example of false contour occurring in a moving picture.
Figure 4:
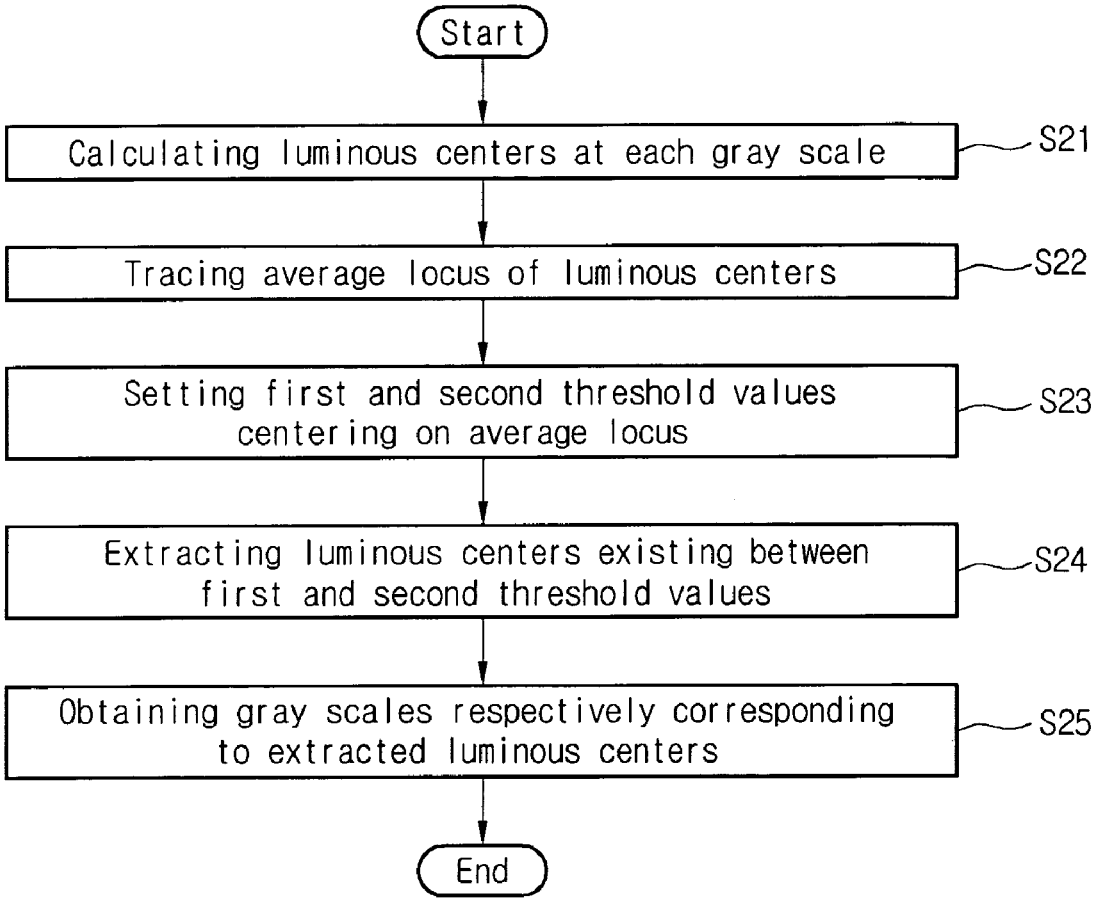
FIG. 4 is a flow chart illustrating a method for obtaining gray scales generating false contour in a plasma display panel according to one preferred embodiment of the present invention.

FIG. 4 is a flow chart illustrating a method for obtaining gray scales not generating false contour in the plasma display panel according to one preferred embodiment of the present invention.

Referring to FIG. 4, luminous centers are calculated on a time axis at each gray scale expressed during one frame period (S21). The luminous centers can be calculated using a light sensor, a simulation or the like. In other words, the luminous centers at each gray scale are actually expressed on a screen of the PDP, and at this time, the luminous centers for the gray scale expressed on the screen of the PDP can be calculated through the light sensor, simulation and so forth. For example, at a frame having 8 sub-fields allocated to allow expression of a gray scale of 256, a variation of the luminous center is not large between a gray scale of 124, a gray scale of 125, a gray scale of 126 and a gray scale of 127, but the variation of the luminous center is very large between the gray scale of 127 and a gray scale of 128.

Figure 6:
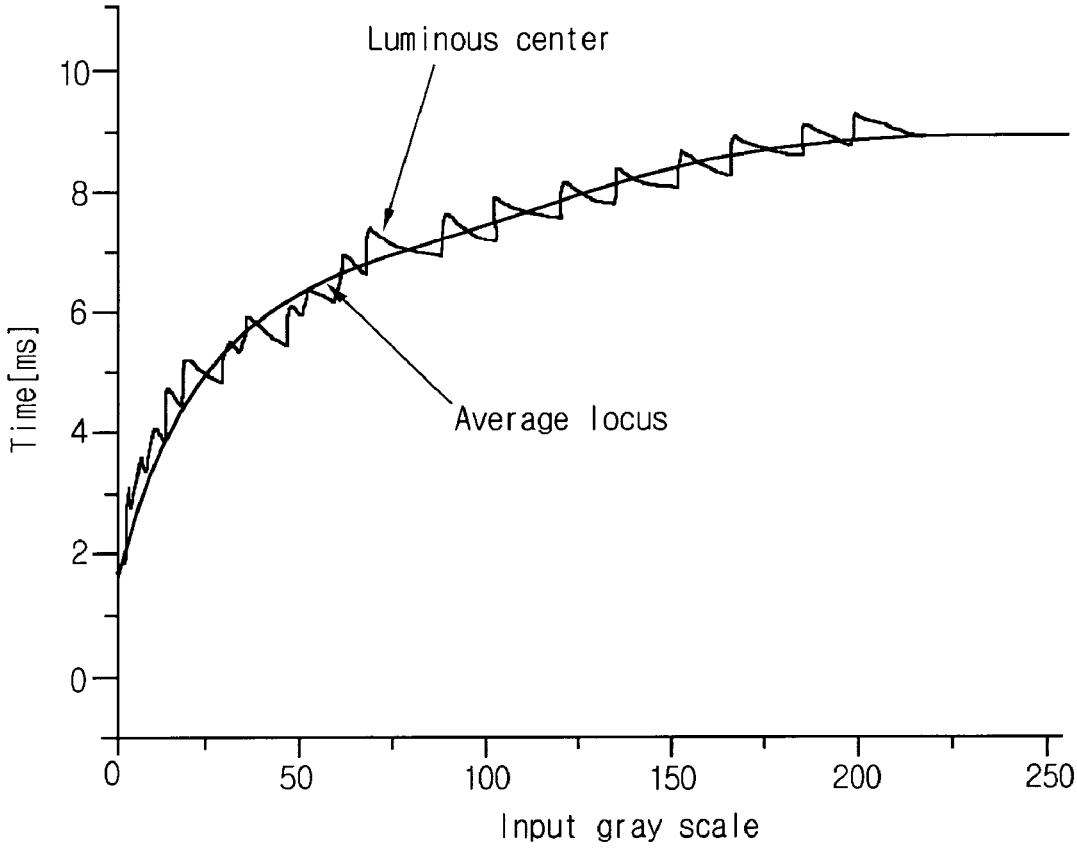
FIG. 6 illustrates luminous centers calculated when each of gray scales is expressed at a sub-field pattern including selective write sub-fields and selective erase sub-fields within one frame period according to a preferred embodiment of the present invention.

Connecting the calculated luminous centers by line is shown as in FIG. 6.

FIG. 6 illustrates the luminous centers calculated when each of the gray scales is expressed at a sub-field pattern including selective write sub-fields and selective erase sub-fields within one frame period according to a preferred embodiment of the present invention.

As shown in FIG. 6, it can be understood that the luminous centers have variation widths different from one another between adjacent gray scales. As described above, the false contour occurs at the gray scales having the variation width of between the adjacent gray scales going beyond a predetermined range.

If the luminous centers at each gray scale are calculated, average values between the luminous centers are obtained and the obtained average values are connected to trace an average locus (S22). As shown in FIG. 6, the average locus is linearly connected between the adjacent gray scales. If each of the gray scale is expressed along the average locus, the luminous centers between the adjacent gray scales become similar with one another such that a brightness difference perceived by an observer's eye does not almost appear. Accordingly, an observer does not almost feel generation of the false contour. In other words, if the moving picture is embodied along the traced average locus, the false contour does not almost appear.

Figure 7:
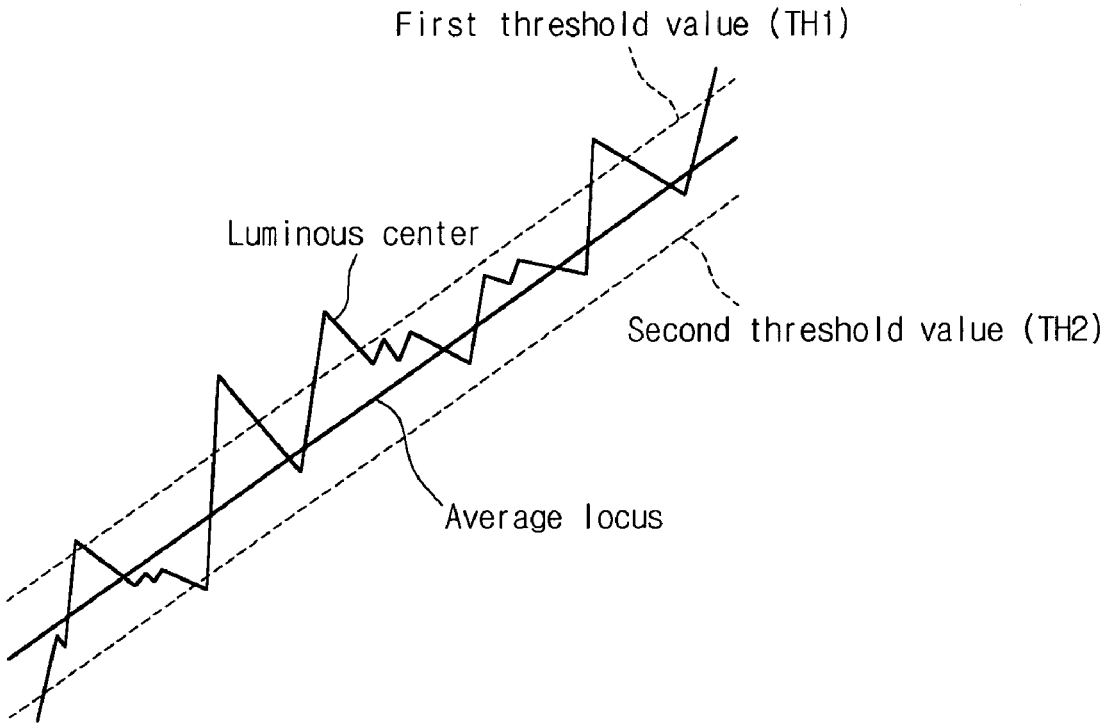
FIG. 7 illustrates a process of extracting gray scales not generating false contour.

If the average locus is traced, as shown in FIG. 7, first and second threshold values TH1 and TH2 are set at positions being at a distance away from the average locus (S23). At this time, it is desirable that the first and second threshold values are set adjacent to the average locus. The reason of setting the first and second threshold values is to fundamentally cut off the gray scales with a concern of the false contour thereby suppressing the false contour to the maximum by extracting the gray scales corresponding to the luminous centers existing between the threshold values to deduce non-extracted gray scales by using the extracted gray scales.

If the first and second threshold values are set centering on the average locus as described above, the luminous centers existing between the first and second threshold values are extracted (S24). Additionally, the gray scales respectively corresponding to the extracted luminous centers (that is, the gray scales not generating false contour) are obtained (S25). At this time, since the luminous centers are not almost differentiated between the obtained gray scales, the false contour is not generated.

The above-obtained gray scales are used to deduce the gray scales respectively corresponding to the luminous centers obviating the first and second threshold values (that is, the gray scales with the conern of the false contour) such that the false contour can be reduced.

Described is a method in which the above-obtained gray scales are applied to the plasma display panel to deduce gray scales actually inputted from an external, as the gray scales no generating false contour depending on whether or not there is the false contour.

Figure 5:
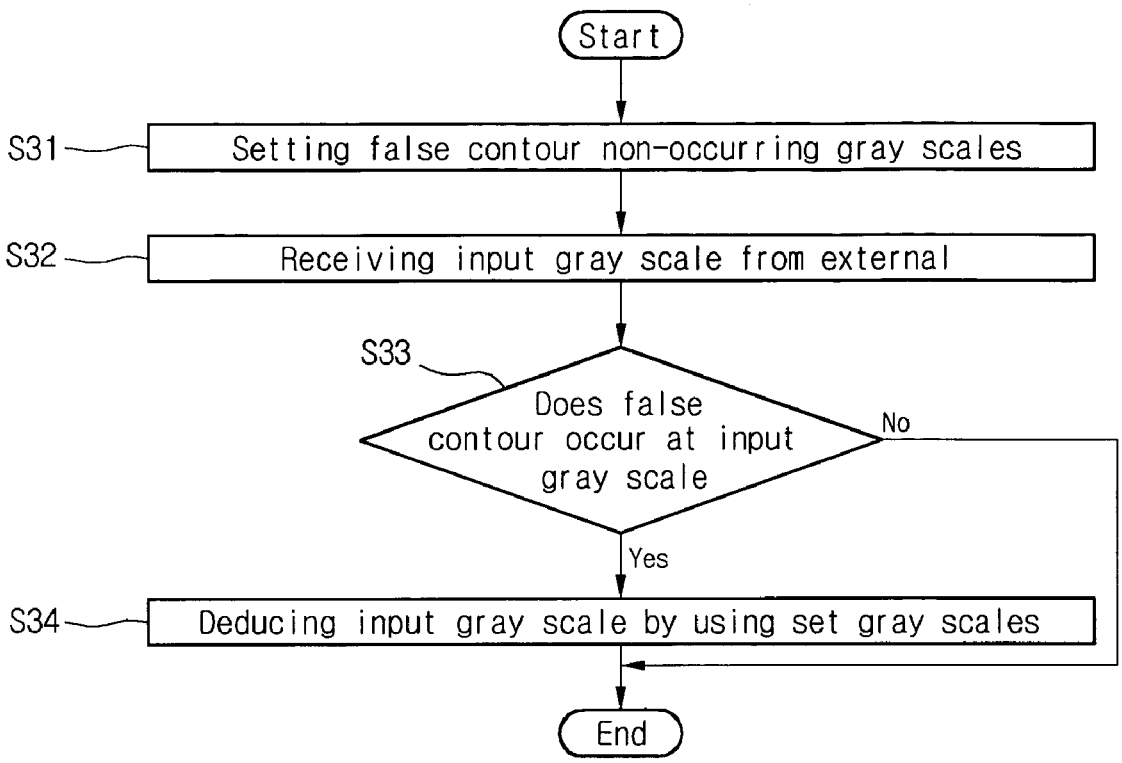
FIG. 5 is a flow chart illustrating a method for deducing gray scales generating false contour by using gray scales not generating false contour in a plasma display panel according to a preferred embodiment of the present invention.

FIG. 5 is a flow chart illustrating the method for deducing the gray scales generating false contour by using the gray scales not generating false contour in the plasma display panel according to a preferred embodiment of the present invention.

Referring to FIG. 5, first of all, the gray scales not generating false contour that are obtained through the above-described method of FIG. 4 are set (S31). This setting is generally registered to a look-up table (that is, a gray scale setting unit of FIG. 8) at a system. The gray scales not generating false contour and the luminous centers respectively corresponding to the gray scales are registered to the look-up table.

If the gray scales not generating false contour are set, the input gray scales are received from an external (S32). At this time, the input gray scales are gray scales extracted from a picture signal inputted from the external.

The received input gray scale is checked whether or not the false contour occurs (S33). That is, the look-up table is inquired to check whether or not the input gray scale exists at the look-up table. If the input gray scale exists at the look-up table, it is the gray scales not generating false contour, and to the contrary, if the input gray scale does not exist at the look-up table, it is the gray scales generating false contour.

In case that it is checked that the input gray scale is the gray scale generating false contour as the checked result, the input gray scale is targeted to deduce the gray scale not generating false contour (S34). That is, in case that the input gray scale is the gray scale generating false contour, the luminous center of the input gray scale is determined to be positioned between corresponding luminous centers by searching the gray scales adjacent to the input gray scale at the look-up table and using the luminous centers of respective the corresponding adjacent gray scales, and the gray scale corresponding to the determined luminous center is deduced as a new gray scale for the input gray scale. Accordingly, if the above deduced gray scale is used for expression on the screen, the luminous centers do not almost have the difference between the deduced gray scale and the adjacent gray scales such that the false contour does not occur.

The above estimation of the input gray scale as the gray scale not generating false contour can be performed using error diffusion, dithering or the like.

Figure 8:
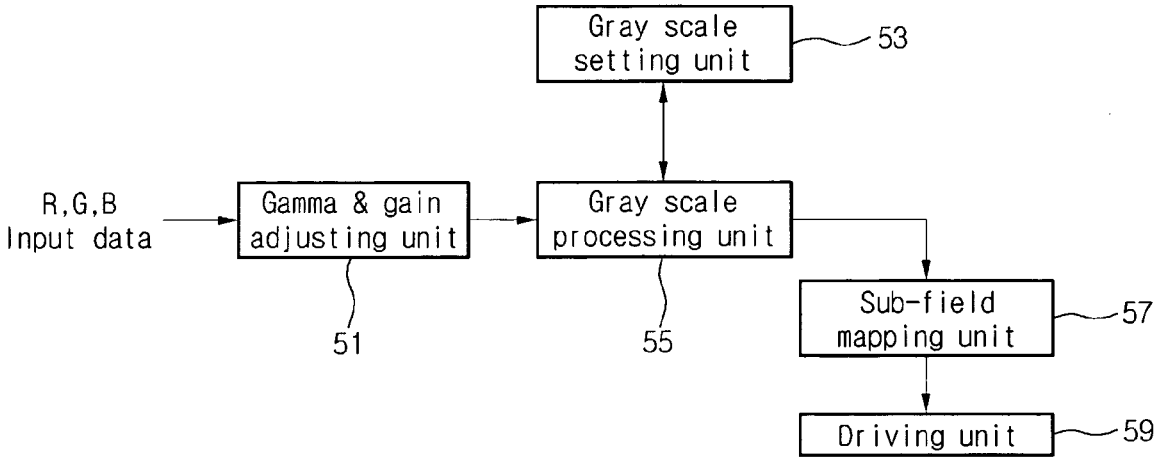
FIG. 8 illustrates a driving apparatus of a plasma display panel according to a preferred embodiment of the present invention.

FIG. 8 illustrates a driving apparatus of the plasma display panel according to a preferred embodiment of the present invention.

Referring to FIG. 8, the driving apparatus of the plasma display panel is comprised of a gamma & gain adjusting unit 51, a gray scale setting unit 53, a gray scale processing unit 55, a sub-field mapping unit 57, a driving unit 58 and the like.

The gamma & gain adjusting unit 51 adjusts a gamma and a gain of input data every Red (R), Green (G) and Blue (B).

The gray scale setting unit 53 is the look-up table for registering the gray scales not generating false contour and the luminous centers respectively corresponding to the gray scales thereto. As described previously, the gray scales existing within a predetermined range from the average locus traced using the luminous centers at each gray scale are registered.

The gray scale setting unit 53 checks whether or not the false contour occurs at a corresponding gray scale of the input data, and helps for deducing the corresponding gray scale as the gray scale not generating false contour in case that the corresponding gray scale is the gray scale at which the false contour can occurs.

The gray scale processing unit 55 checks whether or not the corresponding gray scale of the input data outputted from the gamma & gain adjusting unit 51 is the gray scale at which the false contour can occur, and performs the error diffusion for the input gray scale by using the predetermined gray scales in case that the input gray scale is the gray scale at which the false contour can occur. That is, the gray scale processing unit 55 inquires the gray scale setting unit 53 to check whether or not there is the gray scale consistent with the input gray scale. At this time, it can be respectively checked that the input gray scale is the gray scale not generating false contour if there is the gray scale consistent with the input gray scale at the gray scale setting unit 53, and that the input gray scale is the gray scale generating false contour if there is not the gray scale consistent with the input gray scale at the gray scale setting unit 53.

Accordingly, in case that it is checked that the input gray scale is the gray scale generating false contour, the input gray scale is deduced as the gray scale not generating false contour by the error diffusion. That is, as described above, the luminous centers of the gray scale not generating false contours adjacent to the input gray scale are selected from the gray scale setting unit 53 to calculate the luminous center that is appropriately positioned between the selected luminous centers, and to deduce the gray scale corresponding to the calculated luminous center. The above-deduced gray scale is expressed on the screen without the false contour of the input gray scale together with the adjacent gray scales.

In the meanwhile, besides the error diffusion, the dithering technique can be used to deduce the input gray scale as the gray scale not generating false contour.

If it is checked that the input gray scale is the gray scale not generating false contour, the input gray scale is inputted to the sub-field mapping unit 57 without other processes as it is.

The sub-field mapping unit 57 maps the gray scale outputted from the gray scale processing unit 55, to a predetermined sub-field pattern.

The driving unit 59 drives respective electrodes provided on the panel to express a predetermined gray scale on the screen according to the mapped gray scale.

After all, in the present invention, the gray scales not generating false contour are preset, and the input gray scale is targeted to be checked whether or not there occurs the false contour such that if the input gray scale is the gray scale generating false contour, the preset gray scales are used to deduce the input gray scale as the gray scale not generating false contour, and meanwhile, if the input gray scale is the gray scale not generating false contour, the input gray scale is outputted as it is.

As described above, the driving method and apparatus of the plasma display panel according to the present invention has an effect in that the luminous centers at each gray scale are used to deduce the input gray scale as the gray scale not generating false contour depending on a state of the input gray scale so that the false contour can be remarkably reduced thereby improving a visual quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A method for driving a plasma display panel, the method comprising the steps of:

tracing an average locus by using luminous centers existing at each gray scale;

extracting gray scales corresponding to the luminous centers existing within a predetermined range of the average locus; and deducing non-extracted gray scales by using the extracted gray scales, wherein the gray scale extracting step comprises the steps of:

respectively setting first and second threshold values at positions being at a distance away from the average locus;

extracting the luminous centers existing between the first and second threshold values; and obtaining the gray scales respectively corresponding to the extracted luminous centers.

2. The method according to claim 1, wherein the average locus tracing step comprises the steps of:

calculating the luminous centers existing at each gray scale; and connecting average values of the calculated luminous centers with one another to trace the average locus.

3. The method according to claim 1, wherein the non-extracted gray scales are deduced by error diffusion.

4. The method according to claim 1, wherein the non-extracted gray scales are deduced by dithering.

5. The method according to claim 1, wherein the non-extracted gray scales are deduced using the luminous center positioned between the luminous centers of the extracted gray scales respectively adjacent to the non-extracted gray scales.

6. A method for driving a plasma display panel, the method comprising the steps of:

setting gray scales generating false contour or gray scales not generating false contour to process an input gray scale; and processing the input gray scale by using the set gray scales, wherein the set gray scales are gray scales extracted from an average locus traced using luminous centers at each gray scale, and wherein the gray scales respectively corresponding to luminous centers existing within a predetermined range from the average locus are gray scales generating false contour.

7. The method according to claim 6, wherein the gray scales respectively corresponding to the luminous centers existing outside the predetermined range from the average locus are gray scales not generating false contour.

8. The method according to claim 6, wherein the input gray scale processing step comprises:

referring to the set gray scales to check whether or not the input gray scale is the gray scale generating false contour; and performing error diffusion for the input gray scale by using the set gray scales in case that the input gray scale is the gray scale generating false contour.

9. The method according to claim 8, wherein the error diffusion performs an deduce using the luminous center positioned between the luminous centers of adjacent gray scales existing within the predetermined range of from the input gray scale among the set gray scales.

10. The method according to claim 8, further comprising the step of:

performing dithering for the input gray scale by using the set gray scales.

11. The method according to claim 10, wherein the dithering performs the deduce using the luminous center positioned between the luminous centers of the adjacent gray scales existing within the predetermined range of from the input gray scale among the set gray scales.

12. An apparatus for driving a plasma display panel, the apparatus comprising:

means for setting gray scales generating false contour or gray scales not generating false contour to process an input gray scale; and means for processing the input gray scale by using the set gray scales, wherein the input gray scale processing means comprises:

means for checking whether or not the input gray scale is the gray scale generating false contour, with reference to the set gray scales; and means for performing error diffusion for the input gray scale by using the set gray scales in case that the input gray scale is the gray scale generating false contour.

13. The apparatus according to claim 12, wherein the set gray scales are gray scales extracted from an average locus traced using luminous centers at each gray scale.

14. The apparatus according to claim 12, wherein the error diffusion performs an deduce of a gray scale corresponding to the input gray scale by using adjacent gray scales existing within a predetermined range of from the input gray scale among the set gray scales.

15. The apparatus according to claim 12 further comprising means for performing dithering for the input gray scale by using the set gray scales.

16. The apparatus according to claim 15, wherein the dithering performs the deduce of the gray scale corresponding to the input gray scale by using the adjacent gray scales existing within the predetermined range of from the input gray scale among the set gray scales.

* * * * *